United States Patent [19]

Ginger et al.

[11] 4,347,931

[45] Sep. 7, 1982

[54] MITT

[75] Inventors: Rodney E. Ginger, St. Leon-Rot; Manfred Jungesblut, St. Ilgen, both of Fed. Rep. of Germany

[73] Assignee: Imperial Chemical Industries Limited, London, England

[21] Appl. No.: 862,296

[22] Filed: Dec. 19, 1977

[30] Foreign Application Priority Data

Dec. 23, 1976 [GB] United Kingdom ..... 53942/76

[51] Int. Cl.[3] ..... A61B 19/02

[52] U.S. Cl. ..... 206/438; 206/210; 15/227

[58] Field of Search ..... 206/438, 278, 210; 15/227, 113

[56] References Cited

U.S. PATENT DOCUMENTS

| | | | |
|---|---|---|---|
| 3,342,182 | 9/1967 | Charos | 206/438 |
| 3,384,083 | 5/1968 | Cozza et al. | 206/438 |
| 3,409,010 | 11/1968 | Kron | 206/438 |
| 3,520,401 | 7/1970 | Richter et al. | 206/438 |
| 3,638,789 | 2/1972 | Tuszewski | 15/227 |
| 4,065,826 | 1/1978 | Hough | 15/227 |
| 4,071,921 | 2/1978 | Jury | 15/227 |

*Primary Examiner*—Herbert F. Ross

*Attorney, Agent, or Firm*—Cushman, Darby & Cushman

[57] ABSTRACT

A disposable mitt pack comprises a bag-like mitt for accommodating the hand of the wearer, at least a portion of at least one outer surface of the mitt having thereon a pile impregnated with a desired material. At least the pile area of the mitt is covered by a removable packaging layer which protects the impregnated pile until the layer is stripped away. Preferably the packaging layer is sealed to the mitt itself.

5 Claims, 7 Drawing Figures

MITT

This invention relates to mitts and in particular to impregnated mitts and blanks therefor.

The use of disposable mitts made from pile-surfaced material has already been described in West German Offenlegungsschrift 2554589. Such a mitt comprises a non-porous bag for accommodating the hand, to either or both outer surfaces of the bag are located a pile-surfaced material with the pile-surface outermost. In preferred embodiments the bag is made from low density polyethylene film and the pile-surfaced material is made by a tack-spinning process (as hereinafter described). The tack-spun material is most preferably provided with a porous backing such as for example non-woven cellulose on which is produced a pile of low-density polyethylene fibres or fibrils. The backing is preferably porous because of increased associated water and dirt pick up. Also preferably the pile surfaced material is joined to the bag around at least some of the edge (if rectangular around two opposite, three or four edges) so that the major area in the middle of the material is not joined to the adjacent area of the bag so as to increase water pickup and retention. Such a preferred glove is substantially rectangular and may be made by superimposing appropriately cut pieces of pile-surfaced material onto two pieces of for example low density polyethylene film, and heat sealing the three layers together around three edges. The polyethylene film may extend from the material at the non-sealed end so as to produce a mitt in the form of a gauntlet. The mitt may have appropriate glove shape to accommodate fingers and thumb, and a mitt may comprise a pair, for left and right hands.

A similar mitt but comprising a porous bag, at least one surface of which comprises a pile-surfaced material is described in German Offenlegungsschrift 2,554,588.

Such mitts are very useful in medical applications, particularly in hospitals, where, because of the non-porous bag, the wearer is protected from eg dirt, infection at the place to be wiped and conversely the place to be wiped is isolated from the wearer.

However in medical situations it is generally desirable to treat an area to be wiped with a particular agent for example an antiseptic. If this has to be applied manually to the mitt before wiping, then there are further chances of error such as wrong dose, incorrect agent, dirt and infection being incorporated apart from time required and difficulty to complete the procedure.

To alleviate these difficulties, there is now provided a disposable impregnated mitt in the form of a sealed pack, removal of the seal providing access to the mitt with its pile-impregnated surface. There is also provided a blank for impregnating and sealing so as to produce the sealed pack.

According to the present invention a disposable impregnated mitt is provided which comprises a mitt pack having an outward facing impregnated pile surface, the mitt being located within an impregnant impermeable package, removal of the package revealing the mitt.

The present invention comprehends therefore a package in the form of a sachet made from impregnant impermeable material such as for example metal foil, thermoplastic film, paper laminates with for example metal foil a thermoplastic film preferably with paper side outermost. The mitt (either porous or non-porous as hereinbefore described) together with pile impregnant is located within the sachet. On breaking open the sachet, the mitt is revealed and hence accessible for use.

In an alternative and preferred embodiment, the pack is in the form of a laminate in which an impregnant impermeable material is sealed around the edge of the mitt itself. Where the mitt is itself porous as described for example in German Offenlegungsschrift 2554588, the impregnant impermeable material is sealed at the edges around both porous sides of the mitt and removal of impermeable material reveals the mitt; preferably the impermeable material is sealed at the edges around the closed sides of the mitt, the impermeable material extending outwardly from the open end of the mitt and sealed together, so that on breaking open the seal, the open end of the mitt is revealed. Thence for ease of usage a hand is inserted into the mitt and the impregnated impermeable layers peeled away to leave the mitt on the hand. The non-porous mitt described in German Offenlegungsschrift 2554589 may be provided similarly with front and back impregnant impermeable material but in a preferred embodiment, the back (ie non pile-side of the mitt if the mitt does not have a pile also on the back) being non-porous can act as the impregnant impermeable layer for the back, a separate impregnant impermeable layer being provided for the impregnated pile itself. In such a preferred embodiment there is therefore provided a impregnated mitt pack which comprises:

- a first outer layer of impregnant impermeable material,
- a first inner layer of porous impregnated pile-surfaced material with the pile facing the first outer layer,
- a second inner layer of impregnant impermeable material, and
- a second outer layer of impregnant impermeable material, the first and second inner layers being bonded together over part of the area of the first inner layer, the second layers being bonded together to form the front and back of a hand accommodating region of the mitt and the first outer layer being bonded at its edges to either or both the second layers so as to seal the impregnated pile surface. Accordingly where the first outer layer is bonded to both second layers, in use the bond between second layers must be in part broken to produce an aperture for hand insertion and first outer layer subsequently removed; where the first outer layer is bonded to the second inner layer, an aperture for hand insertion is already present and the first outer layer is subsequently removed; where the first outer layer is bonded only to the second outer layer, removal of the first outer layer reveals the aperture for hand insertion.

In a further embodiment the mitt may be double-sided and therein a fourth inner layer similar to the first inner layer, and a second outer layer similar to the first outer layer are provided, the second outer layer above becoming in effect a third inner layer.

As contemplated herein before the present invention comprehends a blank for preparing the present disposable impregnated mitt pack, which comprises the said pack but before impregnating and sealing.

Any suitable pile-surfaced material may be used although we find it most convenient to use a pile-surfaced material produced by tack-spinning from a thermoplastic material according to the techniques of for example British Pat. Nos. 1,378,638, 1,378,639, 1,378,640, 1,451,311, 1,451,312 and 1,351,313. In the techniques of these patents a laminar pile surfaced material is formed by feeding a thermoplastic material and a backing to a heated surface with the thermoplastic material between the backing and the heated surface so that the thermoplastic softens and bonds to the backing as well as adhering to the heated surface so that the combination of the thermoplastic and the backing may be peeled away from the heated surface so that the thermoplastic is drawn into fibrils or tufts to provide a pile surface. In this process the backing material may be a waterproof thermoplastic which can form one of the layers of the envelope or the fibrillar thermoplastic may be peeled away from the backing as is described in Belgian Pat. No. 824953 and Dutch patent application No. 7501022. When these techniques are used the fibrillar layer may be laminated to the other layers of the envelope by any suitable technique including feeding the fibrillar layer as one of the layers in the heat bonding envelope forming process. A laminar pile-surfaced material may also be made by the process described in British Pat. No. 1,334,672 in which a porous layer is fed between the thermoplastic material and the heated surface with or without a backing.

The pile is preferably fabricated from low density polyethylene. Preferably the backing of the pile surface material is porous because of associated increased wet pickup and retention over material having non-porous backing.

The present impregnated wash mitt may be made for example by forming a sachet around an impregnated mitt or by impregnating the mitt during or after forming the sachet with the mitt enclosed.

Preferably the present impregnated wash mitt is made by additional stages to those described in the aforesaid German Offenlegungsschrifts for making the mitts herein.

A porous mitt may for example be manufactured by a number of suitable methods such as for example superimposing two pieces of porous materials and joining the pieces together, or by folding over one piece of material and joining two edges together to form the bag; the joining may be for example by heat sealing, by using adhesive or by sewing. At least one outside surface must be provided with a pile surface and said pile surface may also be on any other outside or inside surface of the mitt, on both the inside surfaces or outside surface or either on both. In some instances it may be easier to fabricate a mitt having pile surface(s) on its outside by firstly making a mitt having pile surface(s) on its inside followed by turning the mitt inside out. Such a technique may be particularly envisaged when both outside surfaces are to be provided with a pile, and a mitt is first made by heat sealing the internal edge piles, followed by turning the mitt so made inside out.

A non-porous mitt may be made for example from a bag fabricated from a thermoplastic film such as polyethylene film. The bag may be made by sealing together two pieces of film, leaving an aperture to provide access for the hand and then laminating this bag to a layer of pile surfaced material. Alternatively the pile surfaced material may itself be laminated to one of the layers of thermoplastic material which forms one of the walls of the bag. The film (particularly polyethylene) is conveniently lay-flat tubing or such tubing which has been cut at one edge to form lengthwise folded film. The pile surface material preferably formed on a porous eg woven or non-woven backing is placed onto, and laminated to, the film by for example heat sealing around the edge of the material. The forming of the envelope and laminating of material thereon may be consecutive but is preferably concurrent.

In making the present mitt, the impregnant impermeable material may be placed over the pile surface, and over the non-pile carrying porous second layer of a porous mitt and sealed, conveniently heat-sealed to either or both of the non-porous mitt or to the backing impermeable sheet in the porous mitt. The present invention also comprehends mitts with impregnant impermeable material sealed in position, before addition of impregnant and subsequent complete sealing to form the present sealed pack.

The present mitt may be provided with thumb piece and finger pieces. A pair of mitts may be provided for left and right hands. The pile-surface may extend over the whole area of the mitt or over only the palm and/or finger/thumb positions.

The present mitt may be used in a wide range of end-uses depending on the impregnant present. Impregnants or treating material envisaged are for example oils and greases, detergents, paints, polishes, liquid abrasive conpositions, cosmetic materials such as face creams, powders and feminine hygiene products, veternary preparations such as udder creams, and materials for use in hospitals and other human medical applications for example antiseptics such as aqueous or alcoholic solutions of chlorohexidine and cetrimide ("Hibitane" and "Cetavlon" respectively, Imperial Chemical Industries Limited).

The pile and/or backing may be pigmented provided that any dye or pigment is satisfactory for the anticipated end-use. The incorporation of pigments facilitates colour coding according to the impregnant used.

As a wash mitt in hospitals, it has been found that a mitt according to the invention was comfortable to use for both patient and nurse, had a pleasant feel and had good lathering and rinsing properties. A particular advantage was in gynaecological and other applications where high wet strength and softness to infected, sore or raw areas is important. In geriatric applications, the mitt was found to have advantage over hitherto available products in being easy to use with one hand and in aiding confidence in patient rehabilitation. In these applications a mitt in the form of a mitten is particularly useful.

A non-porous mitt of the present invention has the advantage over those made from porous material in that infection and dirt (eg faeces) which may be present through use of the use on the pile surface do not come into contact with the hand of the wearer, so alleviating risk of infecting the wearer and so spreading infection.

The invention is illustrated with reference to the accompanying figures of which FIG. 1 is a plan view of a mitt described in German Offenlegungsschrift 2554589, FIG. 2 is a section on the line I—I of FIG. 1, FIG. 3 is a plan view of the mitt of FIG. 1 in a sealed sachet in accordance with the present invention.

Figure 1:
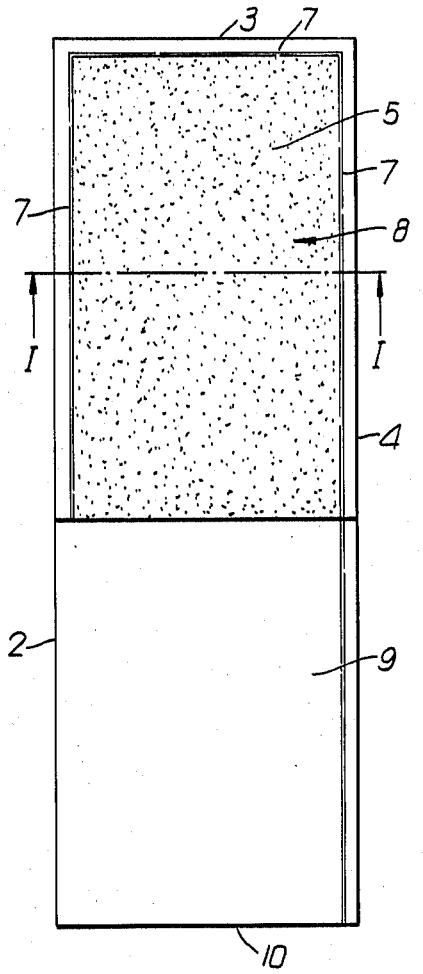
Figure 2:
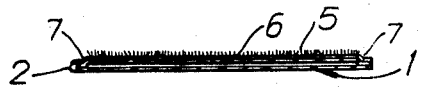

In FIGS. 1 and 2 a piece of low density polyethylene film 1 having a fold about edge 2 is heat sealed about edges 3,4 to form an envelope having mitt shape illustrated in FIG. 1. A pile surface material comprising a pile 5 of low density polyethylene on a non-woven base layer 6 is laminated to the envelope with pile surface uppermost using heat seals 7 and extends over palm area 8 leaving further area 9 at the open end 10 of the envelope to form a sleeve.

The mitt illustrated was made by simultaneously forming heat seal 7 to laminate the pile surfaced material at the edges to the palm side of the future mitt and forming heat seals to produce the polyethylene envelope.

A pile-surfaced material for a mitt according to the present invention was made as follows:

A laminate comprising low density polyethylene (65 $gm^{-2}$) on non-woven cellulose material (50 $gm^{-2}$) was fed at the rate of 1 m per minute against a heated roll (170° C.), the polyethylene side of the laminate being in contact with the heated roll. The laminate was held in contact against the heated roll by a rubber pressure roll. The laminate was peeled from the heated roll over a bar (radius 3 mm) located 1 mm from the heated roll. The pile surfaced material so formed was cooled and stabilised by air at a temperature of 38.5° C. blown against the cellulose side of the material into the pile forming area from apertures in the bar. The flow rate of the air was 550 $Nm^3$.

The resulting material had a short regular hairy polyethylene pile.

Figure 3:
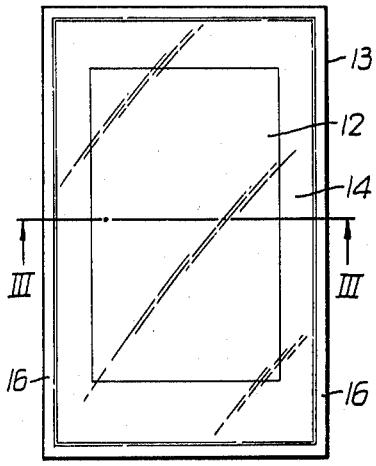

In FIG. 3 a mitt illustrated in outline 12 is sealed within a sachet 13 made from impregnant impermeable material—low density polyethylene film (65 $gm^{-2}$). To form the sachet two layers of film 14, 15 were superimposed (with the mitt inbetween) and heat seals 16 were formed around three sides. A dose of impregnant was injected into the sachet and the sachet sealed by heat-sealing the fourth side.

Figure 4:
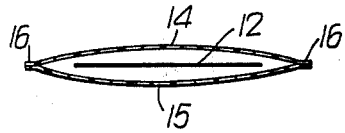
FIG. 4 is a section on the line III—III of FIG. 3.

FIG. 4 is a section on the line III—III of FIG. 3 in which the layers 14,15 of film are slightly separated and cross section details of mitt 12 have been omitted for clarity.

Because the intended use for the mitt was as a hospital antiseptic wipe, the impregnant comprised 10 $cm^3$ of aqueous antiseptic solution, herein as 5% (5 g per 100 $cm^3$ of water) of chlorhexidine gluconate ('Hibitane', Imperial Chemical Industries Limited), the dose being appropriate for said pile having area 300 $cm^2$.

In use the sachet's seal is broken and the impregnated mitt withdrawn for use.

Figure 5:
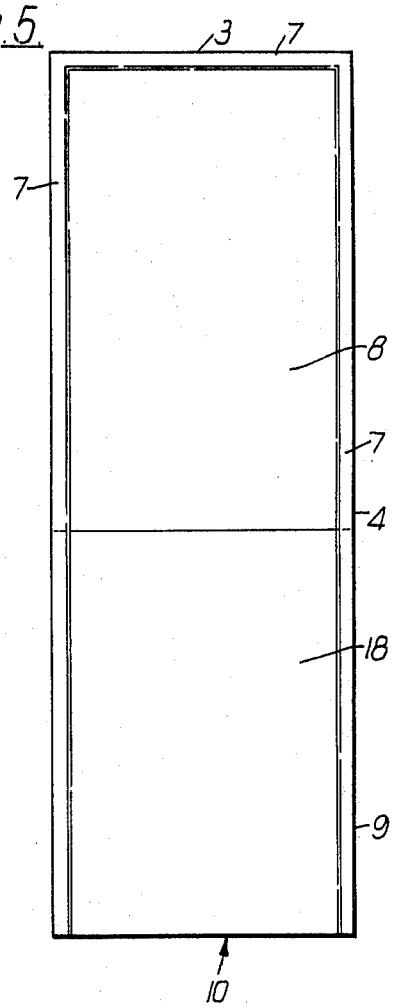
FIG. 5 is a plan view of a preferred mitt in accordance with the present invention but before complete sealing.

FIG. 5 shows a mitt according to the present invention except that sealing is not complete and the end 10 is open. The mitt is similar to that shown in FIG. 1 except that a layer 18 of impregnant impermeable material has been fixed at its edges (except the end 10) over the palm area 8 having a pile-surface and further area 9.

Figure 6:
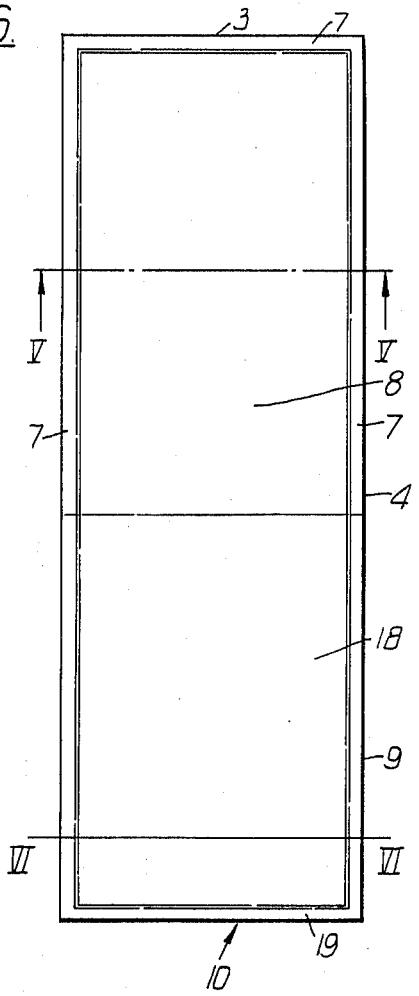
FIG. 6 is a plan view of the mitt of FIG. 5 after complete sealing.
Figure 7:
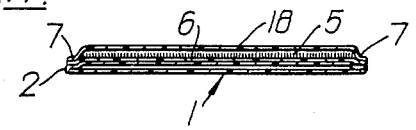
FIG. 7 is a section on the line V—V of FIG. 6.

FIG. 6 shows the mitt of FIG. 5 after impregnation and complete sealing. The mitt of FIG. 5 is impregnated as described for example in respect of the mitt of FIG. 3 by introducing impregnant onto the pile. The mitt is then sealed at 19 by joining together outer layer 18 and the two layers of polyethylene film 1.

In alternative embodiments the further area 9 may be omitted and the pile-surface material may then be joined to the other three layers in seal 19.

To use said mitt of FIG. 6, the mitt is cut or torn on the line VI—VI and the hand inserted into the envelope formed and revealed between the layers 1 of polyethylene film. Outer layer 18 is then removed, conveniently by tearing off, to provide the impregnated mitt ready for use. For ease in tearing, it has been found that the outer layer 18 may be fabricated from high density polyethylene film.

What we claim is:

1. A disposable mitt pack comprising: a bag-like mitt for accommodating the hand of the wearer, said mitt including two overlying layers of impregnant-impermeable material bonded together to form the front and the back of a hand-accommodating region and a hand opening, one of said layers having bonded to its outer surface a porous material, said porous material having a pile on its outer surface impregnated with a desired treating material; and a removable packaging layer of impregnant-impermeable material covering at least the pile area of the mitt so as to protect the impregnated pile until the layer is stripped away, said packaging layer being sealed to the mitt by a continuous seal which surrounds at least the pile area, said continuous seal being formed by a bond between an edge of said removable packaging layer and at least one of said impregnant-impermeable layers, and the removable packaging layer and both of the impregnant-impermeable layers forming the mitt being bonded together at the hand-opening so as to seal said hand opening.

2. A mitt pack as in claim 1 wherein said bonds are heat seal bonds.

3. A mitt pack as in claim 1 in which said pile is a tack spun pile.

4. A mitt pack as in claim 1 wherein said porous material is a non-woven material and wherein said pile is a tack spun polyethylene pile.

5. A mitt pack as in claim 1 wherein said treating material is an antiseptic composition.

* * * * *